United States Patent [19]

Mattson

[11] Patent Number: 4,959,159

[45] Date of Patent: Sep. 25, 1990

[54] BALL AND SOCKET ATTACHMENT FOR FLUID SPRAY GUN PLUNGER

[76] Inventor: Roy D. Mattson, 2194 Deer Pass Trail, White Bear Lake, Minn. 55110

[21] Appl. No.: 386,154

[22] Filed: Jul. 27, 1989

[51] Int. Cl.[5] ..... B05B 7/02

[52] U.S. Cl. ..... 239/526; 239/290

[58] Field of Search ..... 239/525, 526, 527, 528, 239/300, 296–298, 290

[56] References Cited

U.S. PATENT DOCUMENTS

| | | | |
|---|---|---|---|
| 1,524,283 | 1/1925 | Beach | 239/527 |
| 1,682,037 | 8/1928 | Craig | 239/528 |
| 1,751,608 | 3/1930 | Tittemore et al. | 239/528 |
| 1,788,810 | 1/1931 | Tittemore | 239/527 |
| 1,825,864 | 10/1931 | Harter | 239/526 |
| 2,991,940 | 7/1961 | Dupler et al. | 239/527 |
| 3,780,953 | 12/1973 | Malec | 239/526 |
| 3,796,376 | 3/1974 | Farnsteiner | 239/528 |
| 3,836,082 | 9/1974 | Krohn | 239/526 |

*Primary Examiner*—Andres Kashnikow
*Assistant Examiner*—Michael J. Forman
*Attorney, Agent, or Firm*—Jacobson and Johnson

[57] ABSTRACT

In a spray gun for fluids, such as paint, in which an elongated needlenosed plunger is operated by a trigger to move back and forth along the gun barrel for opening and closing a fluid exit opening, the plunger is coupled to the trigger by a ball and socket swivel arrangement to minimize skewing of the plunger while it travels along the barrel.

2 Claims, 2 Drawing Sheets

BALL AND SOCKET ATTACHMENT FOR FLUID SPRAY GUN PLUNGER

FIELD OF THE INVENTION

This invention is directed toward spray guns for fluids, such as paint, which utilize a trigger-operated elongated needlenose plunger which moves longitudinally along the hollow barrel of the gun to open and close the fluid exit port. More specifically, the invention is directed toward providing a swivel mounting of the plunger at its driven or trigger end so that it maintains a substantially straight line travel along the barrel.

DESCRIPTION OF THE PRIOR ART

U.S. Pat. No. 4,817,872 by Mattson dated Apr. 4, 1989 describes a fluid spray gun which operates the same as the fluid spray gun with which the instant invention is used. Fluid such as paint enters the inner chamber of a fluid nozzle mounted concentrically within a hollow gun barrel through a radially extending fitting. Pressurized air is fed from a hollow handle down the barrel around the outside of the nozzle and is expelled through openings in an air cap which closes off the downstream end of the barrel. The air openings are located radially outward from a generally centered fluid exit or outlet port of the nozzle to form the expelled fluid into a conical or fan-shaped pattern. A spring biased elongated needlenose plunger is operated by a trigger at or near the handle to open and close the fluid exit port. The plunger passes slidably through the fluid nozzle and other openings along the barrel. These openings must be well sealed to prevent the fluid in the fluid nozzle from leaking out into the air passageway yet allow the plunger to slide easily back and forth along the barrel. Due to the length of the plunger and the nature of the triggering mechanism the plunger may skew which can result in undue wear on the seals as well as misalignment of the needlenose at the fluid exit port.

SUMMARY OF THE INVENTION

As stated above, the spray gun with which the instant invention is used operates the same as the '872 spray gun. The fluid to be sprayed enters an inner chamber of a nozzle, which is mounted concentrically within the hollow gun barrel, through a radially extending fitting. Pressurized air is fed from the hollow handle down the barrel around the outside of the nozzle and is expelled through openings in an air cap at the open end of the barrel which are radially outward from the center fluid exit or outlet port. A spring biased elongated needlenose plunger extending down the length of the barrel through the inner chamber of the fluid nozzle is operated by a trigger located at the handle to move back and forth lengthwise down the center of the barrel and the fluid nozzle chamber to open and close the fluid exit port. The handle or trigger or upstream end of the plunger has a ball member which seats in a socket to provide some rotational freedom at the trigger end so that the plunger will generally maintain a straight line travel back and forth along the barrel when operated by the trigger mechanism thereby virtually eliminating any skewing. This ensures that the plunger will be in line with the fluid exit port and therefore provide a consistent fluid spray pattern and minimize, if not totally eliminate, undue wear on the seals around the openings through which the plunger slides.

DESCRIPTION OF THE PREFERRED EMBODIMENTS

Figure 1:
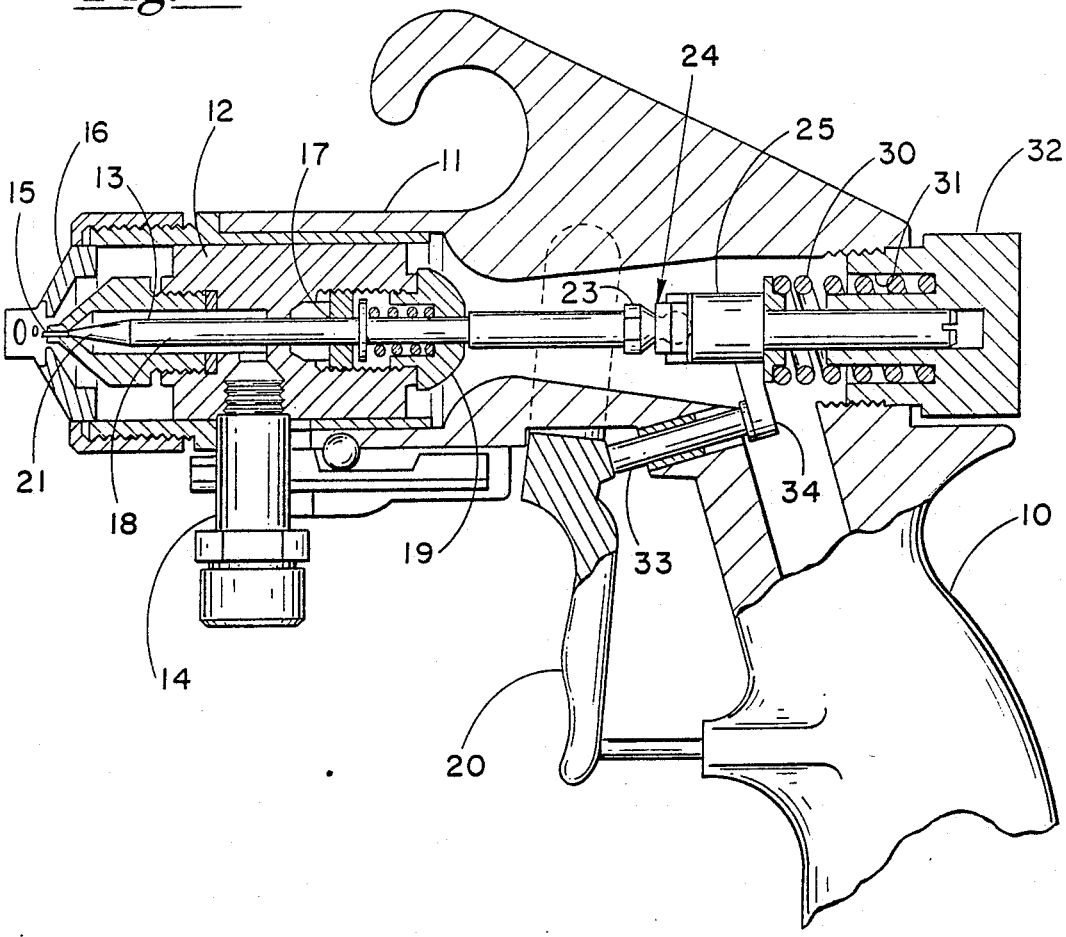
FIG. 1 is a sectioned somewhat detailed view of the fluid spray gun with which the instant invention is used.
Figure 2:
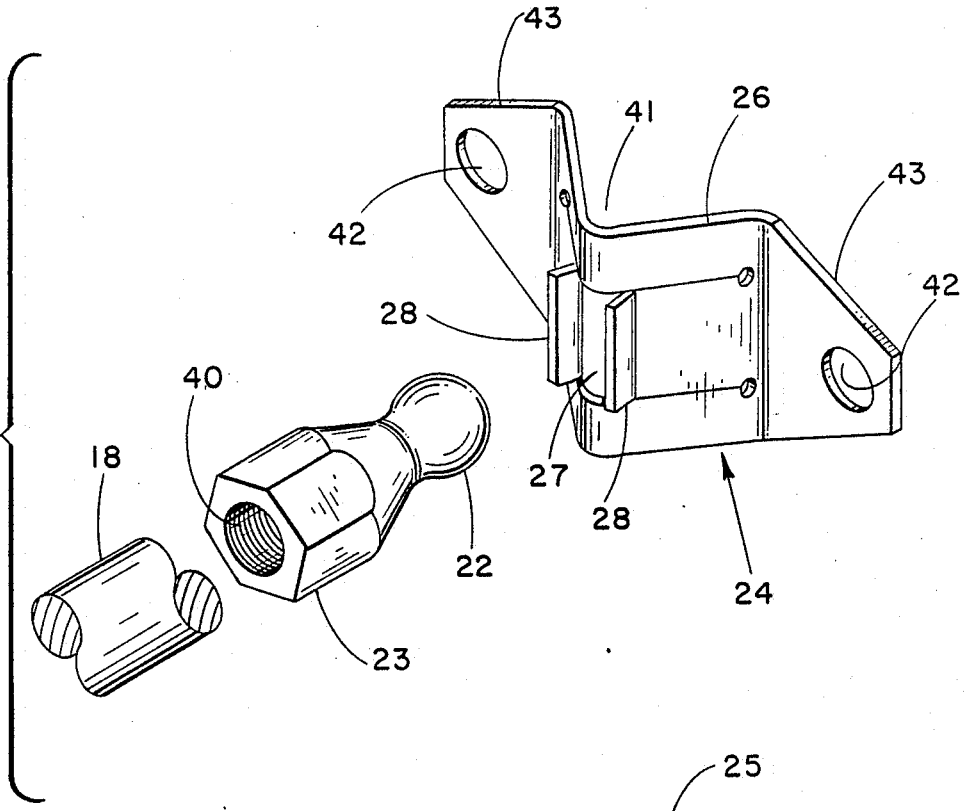
FIG. 2 is a somewhat enlarged perspective view of a preferred embodiment of the invention.
Figure 3:
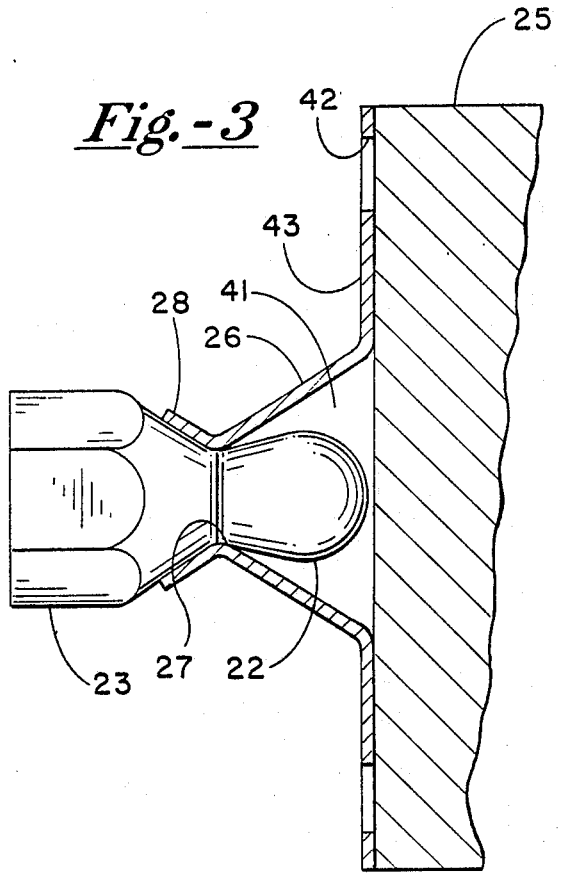
FIG. 3 is a side section view of the embodiment illustrated in FIG. 2.

Since the spray gun per se is not a part of the instant invention and its operation is known, it will not be described herein in great detail. A hollow handle 10 for conveying pressurized air and a hollow elongated barrel, generally designated by reference numeral 11, are molded or otherwise formed as a single integral part. Located in the center and removably mounted coaxial with the barrel is a somewhat elongated generally cylindrically shaped fluid nozzle 12 which has an interior hollow fluid chamber 13 in communication with radially extending threadably engaged fitting 14 through which paint or other fluid enters nozzle chamber 13 from a source not shown. At its downstream end nozzle 12 tapers inwardly and has a small fluid exit port 15 which is aligned with a central opening in an air cap 16 which closes off the downstream end of the barrel 11. Cap 16 has air outlets, not shown, which direct the pressurized air inward to form the ejected fluid into a fan-shaped or cone-shaped pattern. At its other end nozzle 12 is closed off in any suitable fashion and has a sealed opening 17 through which elongated plunger 18 slidably passes. Attached in some convenient fashion to the rear or upstream end of nozzle 12 is a hemispherically shaped nylon pad member 19 which works in conjunction with the air passageway to control the amount of air flow in a manner described in greater detail in the '872 patent. Pressurized air which enters through hollow handle 10 flows down the interior of barrel 11 around the outside of fluid nozzle 12 out the air opening in cap 16. Plunger 18 is operated by a hand operated trigger 20 which is pivotally attached in some convenient fashion to the outside of barrel 11 near handle 10 to slide back and forth along the central axis of barrel 11 and fluid nozzle 12 so that the needlenosed end 21 opens and closes the fluid exit port 15 to control the ejection of fluid which enters chamber 13 from fitting 14 in conventional fashion. Plunger 18 goes through a number of openings as it passes down barrel 11 and through fluid nozzle 12 which openings must be securely sealed so that none of the fluid from the fluid chamber 13 leaks out into the air passageway portion of the barrel. Also, the needlenosed end of plunger 18 should be kept in very close alignment with the fluid exit port 15 so that it opens and closes the fluid port quite precisely and uniformly otherwise the spray pattern can be adversely affected and may not be consistent and uniform.

Attached to the trigger end of plunger 18 is a generally spherical ball member 22. Bell member 22 can be attached to plunger 18 via a stud 23 which has internal threads 40 for engaging external threads (not shown) at the end of plunger 18. Ball member 22 rests or seats in a socket 24 which is attached to one side of a block 25 which is slidably mounted in some fashion in barrel 11. An embodiment of socket 24 may take the form of a "V" shaped member 26 having a center opening 27 with outwardly flaring lips 28. The unstressed width of opening 27 is less than the diameter of ball member 22 but lips 28 are formed in a fashion such that they have some degree of resiliency so that with some force ball member 22 can be inserted through opening 27 to swivably seat within the nesting area 41 of socket 24. Ball member 22, along with plunger 18, will be held in place by socket 24 during normal operation but can be removed, if necessary, for cleaning or replacing plunger 18 by applying a force to pull it out of socket 24. Socket 24 can be attached to block 25 by screws, not shown, inserted through openings 42 in flat wing members 43.

Exerting a force against block 25 axially along barrel 11 on the other side of block 25 is a helical spring 30 which rests in an annular groove 31 in cap or plug 32 which closes off the upstream end of barrel 11 in conventional fashion. Normally spring 30 applies a downstream force on slider block 25 so that plunger 18 keeps fluid opening 15 closed. Rod 33 slidably mounted through handle 10 at one end butts against a flat portion of trigger 20 and at its other end is attached to arm 34 which in turn is attached to block 25. Finger pressure applied to trigger 20 causes rod 33 to slide inward in the handle applying enough force through arm 34 onto slide block 25 to overcome the spring force of spring 30 pulling plunger 18 to open fluid opening 15. When the finger pressure is released then the force of spring 30 returns plunger 18 to the closed condition. By virtue of the swivel engagement of ball 22 in socket 24 for attaching plunger 18 to the triggering mechanism, forces which are applied at the triggering end to operate plunger 18 will not substantially cause plunger 18 to skew away from straight line travel down the axis of barrel 11 so that plunger 18 will consistently and uniformly open and close fluid outlet opening 15 and will not cause any undue wear on the various seals which are used to seal off the openings through fluid cartridge 12 through which the plunger 18 passes.

I claim:

1. In a fluid spray gun having a fluid inlet, an air inlet, a hollow barrel with a fluid exit port and air outlets at one end, a handle attached to the other end of the barrel nd trigger means attached to the barrel near the handle, the improvement comprising:

an elongated plunger extending along the barrel from the handle, said plunger having a pointed end for opening and closing the fluid exit port as the plunger is longitudinally moved;

a ball member attached to the other end of said plunger;

a socket;

means coupling the gun trigger means to said socket for moving said socket back and forth along the barrel in response to the operation of said trigger means;

said socket comprising a chamber for holding said ball member substantially freely rotatable, said socket having a pair of lips defining an opening through which said ball member is insertable into said socket chamber, said lips being resiliently yieldable to permit said ball member to be forcibly inserted into and removed from said socket chamber through said opening yet grasping said ball member when inserted into the socket chamber such that said plunger is moved directly with the back and forth motion of said socket in line with the fluid exit port.

2. In a fluid spray gun having a fluid inlet, an air inlet, a hollow barrel with a fluid exit port and air outlets at one end, a handle attached to the other end of the barrel and trigger means attached to the barrel near the handle, the improvement comprising:

an elongated plunger extending along the barrel from the handle, said plunger having a pointed end for opening and closing the fluid exit port as the plunger is longitudinally moved;

ball and socket connector means between the gun trigger means and the other end of said plunger for moving said plunger in an unskewed line of travel back and forth along the barrel to open and close the fluid exit port in response to the operation of said trigger means;

said ball and socket connector means comprise a socket member and a ball member and an opening in said socket member, said ball member forcibly engaged with or forcibly disengaged from said socket member through said opening;

said ball and socket connector means moving said plunger in response to the operation of said trigger means when said ball member is engaged with said socket member.

* * * * *